United States Patent [19]

Mariol

[11] 4,357,877

[45] Nov. 9, 1982

[54] TOY TRAIN

[76] Inventor: James F. Mariol, 481 Deanview Dr., Cincinnati, Ohio 45224

[21] Appl. No.: 185,158

[22] Filed: Sep. 8, 1980

[51] Int. Cl.[3] ..... B61F 9/00

[52] U.S. Cl. ..... 104/243; 104/53; 105/50; 213/75 TC; 238/10 E; 238/15; 295/33

[58] Field of Search ..... 104/53, 60, 63, 243; 238/10 R, 10 C, 10 E, 15; 46/216, 217, 218, 254, 255, 256, 260, 261; 295/31 R, 33

[56] References Cited

U.S. PATENT DOCUMENTS

| | | | |
|---|---|---|---|
| 138,949 | 5/1873 | Spelman | 104/243 |
| 388,743 | 8/1888 | Thompson | 104/243 |
| 1,618,932 | 2/1927 | Kelly | 238/10 R |
| 1,659,178 | 2/1928 | Wilson | 238/10 R |
| 1,707,615 | 4/1929 | Hunt | 238/10 R |
| 1,996,647 | 4/1935 | Lane | 238/10 E |
| 3,084,637 | 4/1963 | Kohout | 104/243 |
| 3,337,985 | 8/1967 | Ryan et al. | 46/260 |
| 3,540,153 | 11/1970 | Aoki | 46/261 |
| 3,970,309 | 7/1976 | Sato | 273/86 B |
| 4,148,152 | 4/1979 | Barlow et al. | 238/10 R |

FOREIGN PATENT DOCUMENTS

| | | | |
|---|---|---|---|
| 203038 | 4/1959 | Austria | 238/10 R |
| 847873 | 8/1952 | Fed. Rep. of Germany | 46/216 |

*Primary Examiner*—F. Barry Shay

*Attorney, Agent, or Firm*—Wood, Herron & Evans

[57] ABSTRACT

An electric motor driven toy train is disclosed which has a novel wheel and track assembly for minimizing slippage and avoiding binding between the train's wheels and the track as the train goes around a curve section of the track. The train's wheels are each stepped in cross-section with a small diameter rim and a large diameter rim, and the wheels ride on track sections with rails that are also stepped in cross-section. The inside rail of a curve track section is structured so that only the inside train wheels' small diameter rims ride thereover, and the outside rail is structured so that only the outside wheels' large diameter rims ride thereover. The train comprises multiple cars, each of which is articulated about a vertical axis and each of which has only a single axle so as to minimize the turning radius of the train set. A child sits upon the second car, the coal tender, and steers the first car, the locomotive of the set. A small battery driven electric motor drives one wheel of the tender to impart motion to the train set.

7 Claims, 9 Drawing Figures

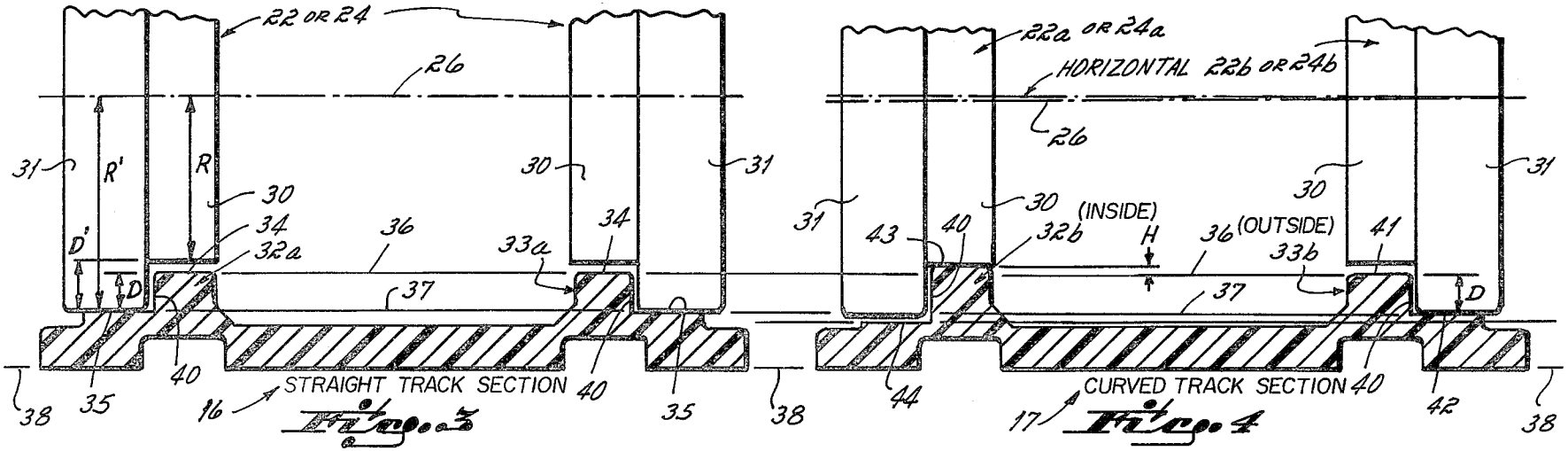
Fig. 4
Fig. 3
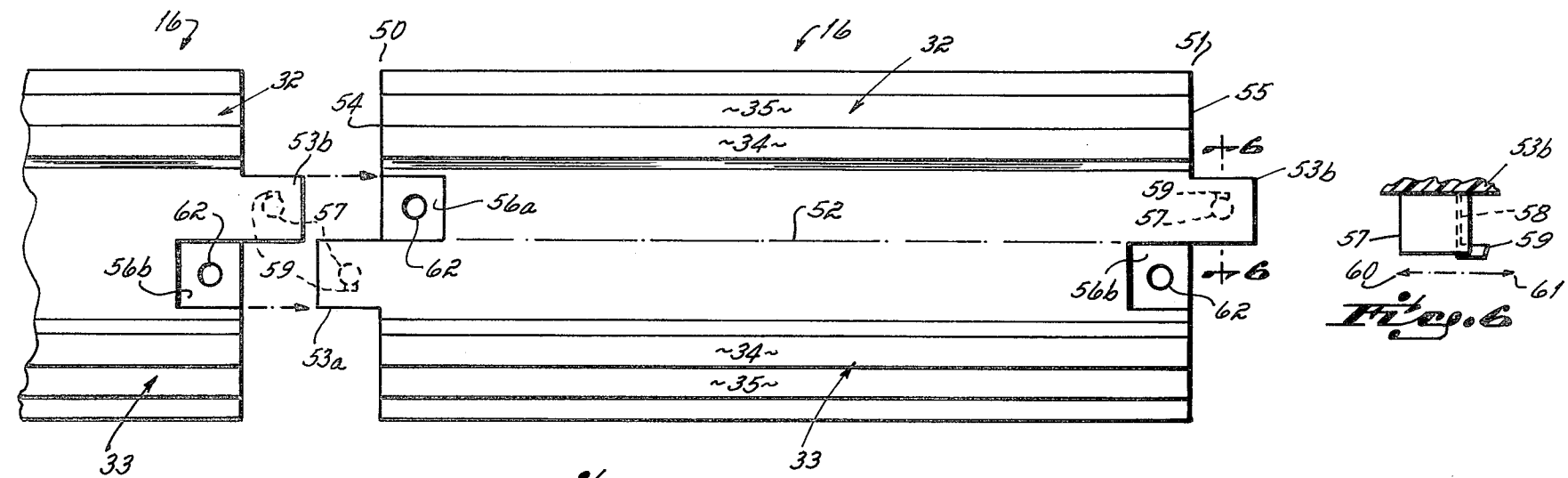
Fig. 5
Fig. 6

TOY TRAIN

This invention relates to toy trains. More particularly, this invention is directed to a toy train that is sized to permit a young child to ride on the train.

Toy trains are, of course, very well known to the prior art. But a couple of problems arise when toy trains are scaled up to a size that permits a young child, e.g., ages two to seven, to ride on the train and act as the engineer as it travels over its train track. One of the problems associated with a toy train and track of sufficient size to carry a child is that the train's wheels tend to bind and slip as the train travels around a curve section of the track. Accordingly, it has been one objective of this invention to provide a novel and improved wheel and track structure for a toy train that tends to minimize interference or binding, and therefore slippage, of the train car's wheels with the track as the train goes around a curved track section. This novel wheel and track assembly permits a relatively small electric motor to be used in the train's locomotive for driving the train over the track and, as a result, permits the motor-driven train to be relatively economically manufactured and sold, and to be battery powered.

Another problem associated with toy trains is that of providing a coupling mechanism by which adjacent train cars may be easily and simply connected and disconnected. Such a simple-to-use coupling mechanism is, of course, quite necessary when the toy train is directed to young children of the two years to seven years age group. Accordingly, it has been another objective of this invention to provide a novel and improved coupling mechanism by which adjacent train cars can be easily and simply connected and disconnected by a relatively young child.

Still another problem associated with toy trains known to the prior art is that of providing a track section connect/disconnect structure by which adjacent track sections can be easily connected and disconnected without regard to matching ends of adjacent sections. In other words, and when a toy train is used by a relatively young child, it is desirable that either end of a first track section be connectable to a given end of a second track section without regard to the end-to-end relationship of the two adjacent track sections. Accordingly, it has been a still further objective of this invention to provide an improved track section connect/disconnect structure that permits either end of one track section to be connected to either end of another adjacent track section by a child of relatively young age.

In accord with the objectives of this invention, the novel and improved train wheel and track assembly includes wheels which are each stepped in cross-section with a small diameter rim and a large diameter rim, and the wheels ride on track sections with rails that are also stepped in cross-section. The inside rail of a curve track section is structured so that only the inside train wheels' small diameter rims ride thereover, and the outside rail is structured so that only the outside wheels' large diameter rims ride thereover, to provide the advantage noted. This structure tends to minimize slippage between the train's wheels and the track as the train goes around a curve section of the track. Also in accord with the objectives of this invention, the improved coupling mechanism includes a latch rod that is permanently connected to a first car's coupling tongue so that it can move vertically relative to ground and so that it can swing in a plane perperdicular to the train's longitudinal axis. When a second car is to be coupled with the first car, the latch rod is swung into a slot in the second car's coupling tongue and the rod's handle is dropped vertically into seated relation with a seat formed in the second car's coupling tongue. When the second car is to be uncoupled from the first car, the latch rod's handle is lifted vertically out of the second tongue's seat, and is pivoted out of the second tongue's slot. This mechanism permits the coupling to be coupled and uncoupled simply by a child's use of swing and pull motions on the latch shank, while insuring that adjacent cars are firmly coupled when that position is desired. The last objective of this invention is accommodated through use of track sections that, at each end thereof, are provided with a tongue and seat structure, the tongue extending beyond the track section's end edge and the seat being formed inwardly of that end edge. A tongue and a seat is provided on each side of the track section's longitudinal center line at opposite ends of each track section so that adjacent sections are connectable by one section's tongue being received in the other section's seat and that one section's seat receiving the other section's tongue. A hollow pin with a spring-loaded detent, extends down from each tongue, the pin being received in a bore in each seat with the spring-loaded detent being adapted to hold the tongue and seat together upon assembly of adjacent track sections.

Other objectives and advantages of this invention will be more apparent from the following detailed description taken in conjunction with the drawings in which:

FIG. 3 is a cross-sectional view taken along line 3—3 of FIG. 1 and illustrating a train car's wheels and associated straight track section in operational assembly;

FIG. 4 is a view similar to FIG. 3 and taken along line 4—4 of FIG. 1, but showing a train car's wheels and associated curved track section in operational assembly;

FIG. 5 is a top view illustrating the connect/disconnect structure for connection adjacent track sections one with another;

FIG. 6 is a cross-sectional view taken along line 6—6 of FIG. 5;

Figure 1:
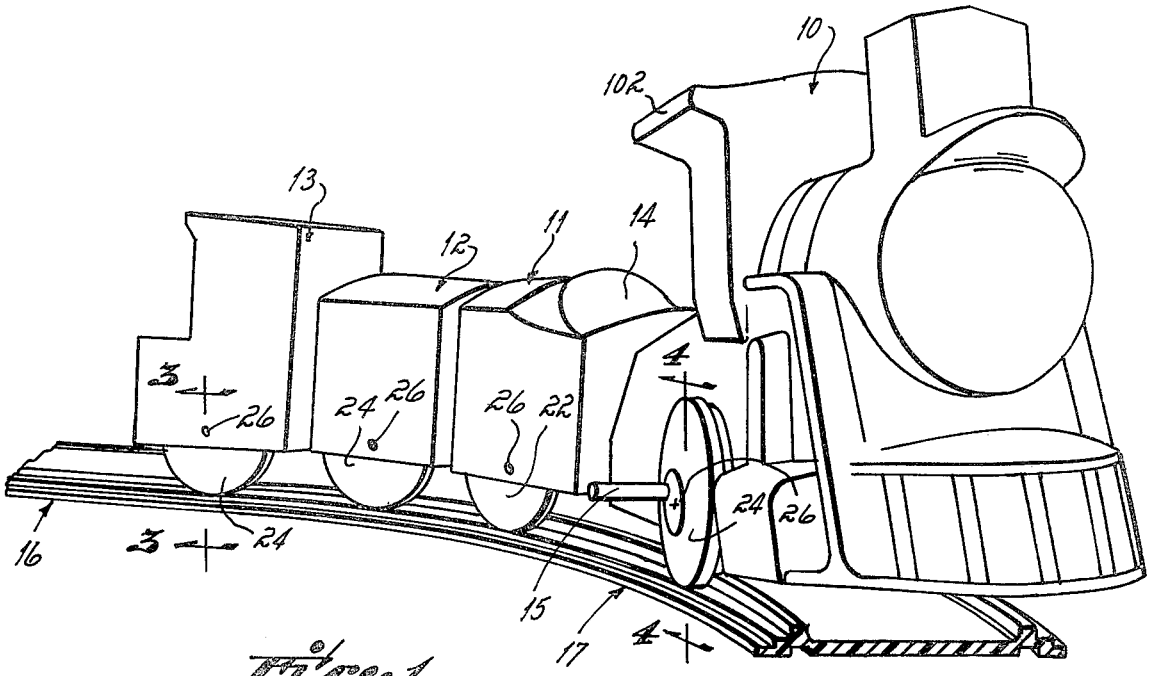
FIG. 1 is a perspective view of a toy train and track in accord with the principles of this invention.
Figure 2:
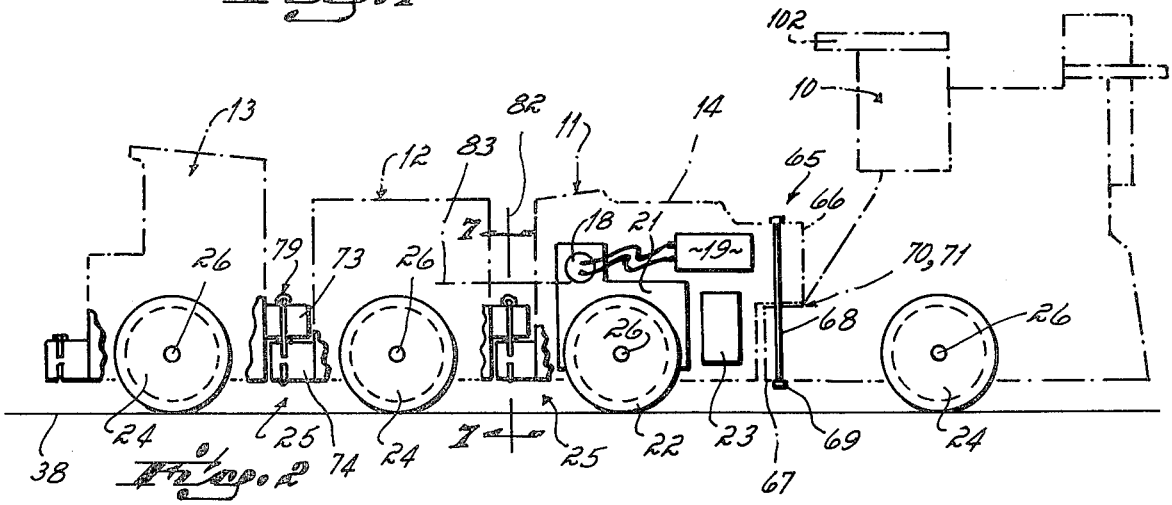
FIG. 2 is a side-elevational view of the toy train illustrated in FIG. 1.

A toy train in accord with the principles of this invention is illustrated diagrammatically in FIGS. 1 and 2. The toy train includes train cars which include a locomotive 10 and tender 11, a gondola 12 and a caboose 13. The tender 11 is provided with a seat 14 on which a young child, e. g., two years to seven years of age, can sit, and the locomotive 10 is provided with foot rests 15 for the child's feet as the train is driven over track 16, 17. The train track 16, 17 is made up of a series of straight sections 16 and a series of curved sections 17 as required to establish any closed-loop track configuration as desired. The toy train is driven by an electric motor 18 connected electrically with a battery 19 by wiring 20 and an electrical switch (not shown). The motor 18 is operative to drive the input shaft (not shown) of a gear box 21, the output of which is drivingly connected with one of the train's driven wheels 22. A battery charger 23 is also provided in the tender 11 for recharging battery 19 when needed.

Each of the train's cars, i.e., the locomotive 10, the tender 11, the gondola 12, and the caboose 13, is provided with only a single pair of wheels 22, 24. The wheels 22,24 are mounted on a single axle that defines rotation axis 26, and all the wheels are particularly structured to cooperate with particularly structured straight track sections 16 and curved track sections 17, see FIGS. 3 and 4. Each of the wheels 22,24 is of a stepped cross-section, each wheel comprising a small diameter inner rim 30 and a large diameter outer rim 31. All wheels 22, 24 are of identical cross-section and size, i. e., the radius R of inner rims 30 is the same for all wheels and the radius R′ of outer rims 31 is the same for all wheels. But the structure of the straight track sections 16 differs from the structure of the curved track sections 17. Both straight 16 and curved 17 track sections, however, are provided with opposed rails 32, 33 each of a stepped cross-section and adapted to cooperate with the stepped wheels 22, 24 of the train's cars 10-13.

With regard to the straight track sections 16, each rail **32*a*, 33*a* is provided with an upper surface 34 and a lower surface 35, the distance D between those surfaces being less than radial difference D′ of each wheel's inner 30 and outer 31 rims. The phantom horizontal plane 36 that includes the upper surfaces 34 of both rails 32*a*, 33*a*, and the phontom 37 horizontal plane that includes the lower surfaces 35 of both rails, are parallel one to the other, and are parallel relative to ground 38 when the track section 16, 17 is laid on a ground support. Therefore, and in use as shown in FIG. 3, when a train's wheels 22, 24 traverse a straight track section 16 it is only the outside rim 31 of the wheels that contact or ride over that section's rails 32*a*, 33*a*, and those outside rims 31 only contact or ride over the lower surface 35 of those rails. This rail 32*a*, 33*a* structure for the straight track sections 16 insures that the rotation axis 26 of each pair of wheels 22,24 is parallel to the upper 36 and lower 37 phantom planes defined by those rails, and, therefore, is parallel relative to ground 38. Of course, the stepped relation of each wheel 22,24 with each rail's vertical surface 40, i.e., with the vertical surface 40 that connects the upper 34 and lower 35 surfaces of each rail 32*a*, 33*a*, insures that a child driver will not drive the train off the track as it is being driven over that straight track section 16**.

The structure of a curved track section 17, as shown in FIG. 4, is different from the structure of a straight track section 16 as shown in FIG. 3. The curved track section 17 includes an inside rail **32*b* and an outside rail 33*b* (relative to the curvature of the track section), each of those rails being adapted to cooperate with inside 22*a*, 24*a* and outside 22*b*, 24*b* train wheels. The outside rail 33*b* of the curved track section 17 is of the same dimensional and geometrical configuration as the two rails 32*a*, 33*a* of the straight track section 16. In this regard, the distance D between the outside rail's upper surface 41 and lower surface 42 is equal to the distance D between upper surface 34 and lower surface 35 on each rail 32*a*, 33*a* of the straight track section 16. Further, and as is apparent from a comparison of FIG. 3 and FIG. 4, in the curved track section 17 the outside rail's lower surface 42 is in the same phantom horizontal plane 37 as the lower surfaces 35 of both rails 32*a*, 33*a* in the straight track section 16 when both track sections are on a ground 38 support, and in the curved track section the outside rail's upper surface 41 is in the same phantom horizontal plane 36 as the phantom horizontal plane that includes the upper surfaces 34 of the straight track section's two rails 32*a*, 33*a*. This structural relation results, in use, in the outer rims 31 of a train's outer wheels 22*b*, 24*b* riding on the lower surface 42 of the curved section's outside rail 33*b* with a gap established between the outside wheels' inner rims 30 and the outside rail's upper surface 41 all as shown in FIG. 4. The structural configuration and dimensional relations of each curved section's inside rail 32*b*, however, differs from each curved section's outside rail 33*b* and, therefore, also from both rails 32*a*, 33*a* of the straight sections 16. Each curved section's inside rail 32*b* has an upper surface 43 upraised relative to the phantom horizontal plane 36 that includes upper surface 41 of that curved section's outside rail 33*b*. Further, lower surface 44 of each curved section's inside rail 32*b* is lowered relative to the phantom horizontal plane 37 that includes lower surface 42 of that curved section's outside rail 33*b*. In use, therefore, this structural relation insures that small diameter rims 30 of the train's inside wheels 22*a*, 24*a* ride only on the inside rail's upper surface 43, and that a gap is established between large diameter rims 31 of the inside wheels 22*a*, 24*a* and the inside rail's lower surface 44. The vertical height difference H between the inside rail's upper surface 43 and the outside rail's upper surface 41 is such that the axis 26 of the wheels 22*b*, 24*b* will be tilted slightly downward from the outside rail 33*b* toward the inside rail 32*b* as shown in FIG. 4, i.e., will be tilted relative to ground 38. Further, the dimensional relationship of the rail radius or curvature of the curved section with the radius of the wheels' inside rim 30 and outside rims 31 is such that slippage between the wheels 22, 24 and the rails 32*b*, 33*b* is minimized as the wheels go around a curved track section 17 because the outside wheels 22*b*, 24*b* ride on the large diameter rims 31 of those outside wheels and the inside wheels 22*a*, 24*a* ride on the small diameter rims 30 of those inside wheels. This track to wheel relationship tends to avoid interference or binding of the train's wheels on the track's curve and, as a result, allows a relatively small motor 18 and battery 19 drive package to be used in driving the toy train over a closed loop track 16, 17**.

Straight track sections 16, in accord with the principles of this invention, are adapted to be connected end to end without regard to matching of ends 50, 51 of those track sections. The connect/disconnect structure by which end to end connection is achieved is illustrated in FIGS. 5 and 6. Each straight track section 16 is provided with a tongue **53*a*, 53*b* that extends outwardly beyond each end edge 54, 55 of that section, and an adjacent seat 56*a*, 56*b* which extends inwardly of each end edge 54, 55 of that section. Relative to the longitudinal center line 52 of the straight track section 16, the tongue 53*a* at one end 54 of the track section 16 is disposed on a first side of the section's longitudinal center line 52, and the tongue 53*b* at the other end 55 of the track section is disposed on a second side of the longitudinal center line 52. Similarly, the seat 56*a* at one end 54 of the track section 16 is provided on the second side of the longitudinal center line 52, and the seat 56*b* on the other end 55 of the track section is provided on the first side of the longitudinal center line. In other words, a tongue 53***a* at one end 54 and a seat 56*b* at the other end 55 are provided on one side of the section's longitudinal center line 52, and the seat 56*a* at the one end 54 and the tongue 53*b* at the other end are provided on the other side of the longitudinal center line. The tongues 53 are sized and configured to seat in the seats 56 when adjacent track sections 16*a*, 16*b* are aligned one with the other as shown in FIG. 5 so that an inter-lock arrangement is established between those sections.

Each tongue 53 also is provided with a hollow depending post 57, see FIGS. 5 and 6. A spring 58 loaded detent 59 is mounted within the post 57, and is movable in the direction shown by phantom arrow 60 in FIG. 6 in order to withdraw the detent against spring bias direction 61 into the confines of the post as the post is received in through-bore 62 of an associated seat 56. Once the post 57 is in the seat's bore 62, the detent 59 is released so as to retain adjacent track sections 16 in structural assembly. This connect/disconnect structure at each end of a straight track section 16 allows either end of one track section 16*a* to be connected with a given end of an adjacent track section 16*b*, thereby allowing the adjacent straight track sections to be easily assembled even by children of young years.

The coupling mechanism by which adjacent train cars are connected one with the other is shown in FIGS. 2 and 7–9. The locomotive 10 is permanently connected to the tender 11 by a coupling 65 that includes an upper coupling tongue 66 on tender 11 bolted to lower coupling tongue 67 on locomotive 10. The two coupling tongues 66, 67 are maintained in permanently coupled relation by a bolt 68 and nut 69, the two tongues permitting the tender to pivot relative to the locomotive on bearing surfaces 70, 71 established therebetween. This is a standard coupling arrangement. However, a coupling 72 in accord with the principles of this invention is used to connect the train's tender 11 with the train's gondola 12, and is used to connect the train's gondola 12 with the train's caboose 13.

Figure 7:
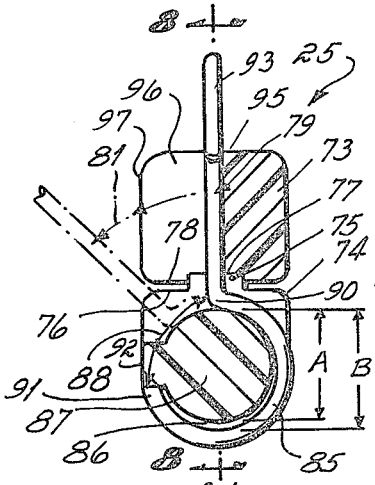
FIG. 7 is a cross-sectional view taken along line 7—7 of FIG. 2 and illustrating a coupling mechanism in operational assembly.
Figure 8:
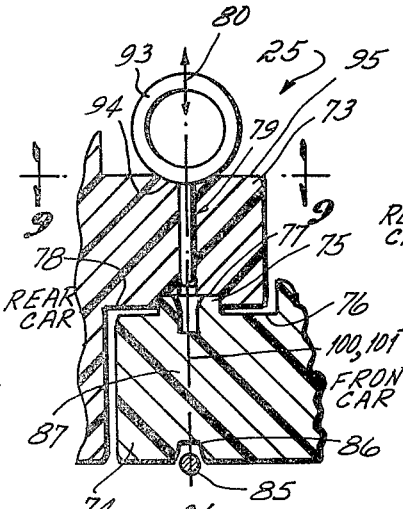
FIG. 8 is a cross-sectional view taken along line 8—8 of FIG. 7.
Figure 9:
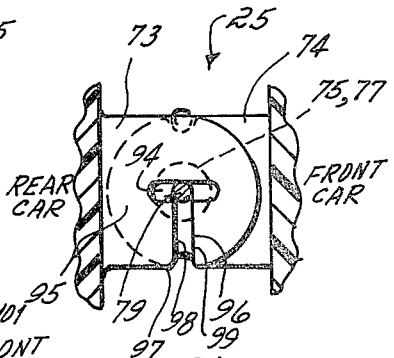
FIG. 9 is a cross-sectional view taken along line 9—9 of FIG. 8.

The novel coupling mechanism 25, which is particularly illustrated in FIGS. 7–9, includes an upper coupling tongue 73 mounted to and extending forwardly from a rear car and a lower coupling tongue 74 mounted to and extending rearwardly from a front car relative to two adjacent train cars. The front car's lower tongue 74 is provided with a bearing post 75 in the top surface 76 thereof, and the rear car's upper tongue 73 is provided with a bearing seat 77 in the bottom surface 78 thereof, the post 75 and seat 77 being engageable in bearing or swivel relation as shown in FIGS. 7 and 8. A latch rod 79 is permanently connected to the front car's lower tongue 74 so that it can move vertically (as shown by phantom arrow 80) relative to ground 38, and so that it can swing (as shown by phantom arrow 81) in a plane 82 perpendicular to the train's longitudinal axis 83. The latch rod 79 is connected to the front car's lower tongue 74 through an open ring shaped connector 85 at one end of the rod 79 that is received in a lower tongue slot 86 defined by cylindrical swing post 87. The swing post 87 has a swing axis parallel to the train's longitudinal axis. The swing post 87 is of a diameter A substantially less than the diameter B of the ring shaped connector 85, thereby permitting the rod 79 to swing (as shown by arrow 81) relative to the post as well as to move radially inward and outward (as shown by arrow 80) relative to the post. Since the open ring shaped connector 85 defines a gap 88 therein, ends 90, 91 of that gap cooperate with offset 92 of the swing post 87 to limit the swing path 81 motion of the latch rod 79. The rod 79 and connector 85 are, therefore, oriented in the same generally vertical plane 82, and gravity normally urges both to the FIGS. 7 and 8 position when the rod 79 is upright as shown in those figures. The other end of the latch rod 79 is formed integral with a ring handle 93 for operating the latch rod. The ring handle 93 is adapted to rest in a seat 94 cut in the top surface 95 of the upper coupling tongue 73, as biased thereto by gravity, when the upper 73 and lower 74 coupling tongues are coupled together. A slot 96 cut in one side edge 97 of the upper coupling tongue 73 permits the latch rod 79 to be moved between the coupled position shown in solid lines in FIGS. 7–9 and the uncoupled position shown in phantom lines in FIG. 7. Of course, opposed faces 98, 99 of the upper tongue's slot 96 cooperate with the latch rod 79 to retain the cars 11, 12 in coupled assembly shown in the figures. This upper tongue's slot 96 is in a vertical plane 100 perpendicular to the train's longitudinal axis 83 and coplanar with the plane 101 of the lower tongue's slot 86.

In use, therefore, the latch's ring handle 93 is received in seat 94 defined in the upper coupling tongue (which seat 94 and handle 93 are oriented generally transverse to the upper tongue's slot 96 for the latch rod 79), the handle 93 being seated in the seat 94 due to gravity. This holds the upper 73 and lower 74 coupling tongues (and, therefore, a pair of cars) one to the other, and prevents the latch rod 79 from falling out of latching relation with the slot 96. When disconnection of a pair of cars is desired, the ring handle 93 is simply lifted upwardly out of the seat 94 in the upper coupling tongue 73 (as permitted by the clearance gap between the open connector ring 85 and the lower coupling tongue's swing post 87) and the latch rod 79 then pivoted in the direction shown by phantom arrow 81 (as permitted by the upper coupling tongue's slot 96 and the lower coupling tongue's slot 86) until the latch rod is removed from the upper tongue's slot 96. The latch rod 79 remains connected to the lower coupling tongue 74 because of the open ring connector 85 and swing post 87 structure. This, of course, permits the upper coupling tongue 73 to be lifted off the bearing post 75 and out of connected assembly with the lower coupling tongue 74. Reconnection of a rear/front car pair is achieved by an opposite sequence of steps.

In operation of the toy chain, a child sits up on the seat 14 of the tender 11 with his feet resting upon the footrest 15. To steer the train he grasps the handles 102 of the first car, the locomotive. In order to impart motion to the train, the child then closes a switch (not shown) connecting the battery 19 to the motor 18. Closing of the circuit between the battery 19 and motor 18 has the effect of closing an electrical circuit between the two and imparting motor drive to one wheel 22 of the tender car through its gear box transmission 21. Since the child is sitting upon the tender 11, his weight tends to force the one driven wheel into contact with the track with sufficient force to impart drive to the train without the occurrence of slippage between the driven wheel and the track. Because only one wheel 22 is driven, there is no need for a differential between the two wheels to avoid slippage between the wheels and the track as the train moves around a curve.

While the train set of this application has been described as being operational upon a track, it is to be noted that the train is fully operational in the absence of a track; that is, it may move over a flat floor as well as over a track. In that event the handles 102 of the locomotive function to enable the child riding the tender 11 to steer the locomotive 10 and thus steer the train set.

Having described in detail the preferred embodiment of my invention, what I desire to claim and protect by Letters Patent is:

1. A toy train and track assembly, said assembly comprising a train car having a pair of wheels each of which is of stepped cross section to define two separate rims, one rim of each wheel being of a smaller diameter and the other rim of that wheel being of a larger diameter, and a curved track section having an inside rail and an outside rail, each of said inside and outside curved rails being of stepped cross-section to define upper and lower surfaces for cooperating with the stepped cross section of said car's wheels, said wheels and said rails being structurally configured and dimensionally related so that, as said wheels traverse said curved track section, one said wheel's larger diameter rim rests on one said rail's lower surface and its smaller diameter rim is free of bearing contact with said one rail, while the other said wheel's smaller diameter rim rests on the other said rail's upper surface and its larger diameter rim is free of bearing contact with said other rail.

2. An assembly as set forth in claim 1, the outside wheel's large diameter rim resting on the outside rail's lower surface and the inside wheel's small diameter rim resting on the inside rail's upper surface.

3. An assembly as set forth in claim 2, said track section's inside and outside rails being structurally configured and dimensionally related to said wheels so that the rotation axis of said wheels is slanted relative to ground as said wheels traverse said curved track section.

4. An assembly as set forth in claim 3, said inside rail's upper surface being upraised above said outside rail's upper surface relative to ground.

5. An assembly as set forth in claim 4, said inside rail's lower surface being lowered relative to said outside rail's lower surface relative to ground.

6. An assembly as set forth in claim 1, said assembly comprising a straight track section, each straight rail being of stepped cross section to define straight upper and lower surfaces, the upper surfaces of said straight rails being located in a first common phantom horizontal plane relative to ground and the lower surfaces of said straight rails being located in a second common phantom horizontal plane relative to ground.

7. An assembly as set forth in claim 6, the upper surface of said curved outside rail being located in the same phantom horizontal plane as the upper surfaces of said straight rails, and the lower surface of said curved outside rail being located in the same horizontal plane as the lower surfaces of said straight track rails, relative to ground.

* * * * *